US010329499B2

(12) United States Patent
Shafi et al.

(10) Patent No.: US 10,329,499 B2
(45) Date of Patent: Jun. 25, 2019

(54) INTEGRATED HYDROTREATING AND STEAM PYROLYSIS SYSTEM INCLUDING HYDROGEN REDISTRIBUTION FOR DIRECT PROCESSING OF A CRUDE OIL

(71) Applicant: Saudi Arabian Oil Company, Dhahran (SA)

(72) Inventors: Raheel Shafi, Manama (BH); Abdennour Bourane, Ras Tanura (SA); Essam Sayed, Dhahran (SA); Ibrahim A. Abba, Dhahran (SA); Abdul Rahman Zafer Akhras, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 15/824,384

(22) Filed: Nov. 28, 2017

(65) Prior Publication Data

US 2018/0079975 A1 Mar. 22, 2018

Related U.S. Application Data

(63) Continuation of application No. 15/062,605, filed on Mar. 7, 2016, which is a continuation of application (Continued)

(51) Int. Cl.

*C10G 69/06* (2006.01)
*C10G 45/00* (2006.01)

(Continued)

(52) U.S. Cl.

CPC ..... *C10G 69/06* (2013.01); *C10G 9/36* (2013.01); *C10G 19/00* (2013.01); *C10G 45/00* (2013.01);

(Continued)

(58) Field of Classification Search

CPC ..... C10G 21/003; C10G 2300/201; C10G 2300/308; C10G 2300/4081;

(Continued)

(56) References Cited

U.S. PATENT DOCUMENTS 3,842,138 A 10/1974 Chahvekilan et al.
3,944,481 A 3/1976 Wing et al.

(Continued)

FOREIGN PATENT DOCUMENTS

WO 2007047942 A2 4/2007
WO 2009088413 A1 7/2009

OTHER PUBLICATIONS

Harper, S, Chevron Port Arthur ethylene expansion meets objectives, Oil and Gas Journal, 1999, vol. 97, Issue 19.*

(Continued)

*Primary Examiner* — Renee Robinson
*Assistant Examiner* — Derek N Mueller
(74) *Attorney, Agent, or Firm* — Abelman, Frayne & Schwab

(57) ABSTRACT

Steam pyrolysis and hydroprocessing are integrated including hydrogen redistribution to permit direct processing of crude oil feedstocks to produce petrochemicals including olefins and aromatics. A feed is initially split into a light portion and a heavy portion, and the heavy portion is hydroprocessed. A hydroprocessed effluent is charged, along with steam, to a convection section of a steam pyrolysis zone. The mixture is heated and passed to a vapor-liquid separation section. A residual portion is removed and light components are charged to a pyrolysis section of the steam pyrolysis zone. A mixed product stream is recovered from the steam pyrolysis zone and it is separated into product including olefins and aromatics.

24 Claims, 3 Drawing Sheets

Related U.S. Application Data

No. 13/865,043, filed on Apr. 17, 2013, now Pat. No. 9,279,088, which is a continuation-in-part of application No. PCT/US2013/023336, filed on Jan. 27, 2013.

(60) Provisional application No. 61/789,965, filed on Mar. 15, 2013, provisional application No. 61/591,814, filed on Jan. 17, 2012.

(51) Int. Cl.

| | |
|---|---|
| ***C10G 55/04*** | (2006.01) |
| ***C10G 9/36*** | (2006.01) |
| ***C10G 19/00*** | (2006.01) |

(52) U.S. Cl.

CPC ..... *C10G 55/04* (2013.01); *C10G 2300/201* (2013.01); *C10G 2300/202* (2013.01); *C10G 2300/205* (2013.01); *C10G 2300/308* (2013.01); *C10G 2400/20* (2013.01); *C10G 2400/22* (2013.01); *C10G 2400/30* (2013.01)

(58) Field of Classification Search

CPC ..... C10G 2400/20; C10G 2400/30; C10G 45/00; C10G 67/0463; C10G 67/049; C10G 69/06; C10G 9/36

See application file for complete search history.

(56) References Cited

U.S. PATENT DOCUMENTS

| | | | | |
|---|---|---|---|---|
| 4,002,556 | A | 1/1977 | Satchell | |
| 4,065,379 | A | 12/1977 | Soonawala et al. | |
| 4,115,467 | A | 9/1978 | Fowler | |
| 4,180,453 | A | 12/1979 | Franck et al. | |
| 4,798,665 | A | 1/1989 | Humbach et al. | |
| 5,192,421 | A | 3/1993 | Audeh et al. | |
| 5,258,117 | A | 11/1993 | Kolstad et al. | |
| 5,906,728 | A | 5/1999 | Iaccino et al. | |
| 6,190,533 | B1 | 2/2001 | Bradow et al. | |
| 6,210,561 | B1 | 4/2001 | Bradow et al. | |
| 6,303,842 | B1 | 10/2001 | Bridges et al. | |
| 6,632,351 | B1 | 10/2003 | Ngan et al. | |
| 7,138,047 | B2 | 11/2006 | Stell et al. | |
| 7,220,887 | B2 | 5/2007 | Stell et al. | |
| 7,311,746 | B2 | 12/2007 | Stell et al. | |
| 7,408,093 | B2 | 8/2008 | Stell et al. | |
| 7,951,745 | B2 | 5/2011 | Zhou et al. | |
| 7,972,498 | B2 | 7/2011 | Buchanan et al. | |
| 8,070,938 | B2 | 12/2011 | Stein et al. | |
| 8,071,833 | B2 | 12/2011 | Grootjans et al. | |
| 2004/0004028 | A1 | 1/2004 | Stell et al. | |
| 2004/0054247 | A1 | 3/2004 | Powers et al. | |
| 2005/0261530 | A1 | 11/2005 | Stell et al. | |
| 2007/0090018 | A1 | 4/2007 | Keusenkothen et al. | |
| 2007/0090020 | A1 | 4/2007 | Buchanan et al. | |
| 2007/0232846 | A1 | 10/2007 | Baumgartner et al. | |
| 2010/0087692 | A1 | 4/2010 | Yoshimura et al. | |
| 2011/0042269 | A1* | 2/2011 | Kuechler ..... | C10G 9/38 208/57 |
| 2011/0174682 | A1 | 7/2011 | Iaccino | |
| 2011/0247500 | A1 | 10/2011 | Akhras et al. | |

OTHER PUBLICATIONS

PCT/US2013/023336, International Search Report and Written Opinion dated Aug. 20, 2013, 13 pages.

* cited by examiner

INTEGRATED HYDROTREATING AND STEAM PYROLYSIS SYSTEM INCLUDING HYDROGEN REDISTRIBUTION FOR DIRECT PROCESSING OF A CRUDE OIL

RELATED APPLICATIONS

This application is a continuation application of U.S. patent application Ser. No. 15/062,605 filed on Mar. 7, 2016, which is a continuation application of U.S. patent application Ser. No. 13/865,043 filed on Apr. 17, 2013, which claims the benefit of priority under 35 USC § 119(e) to U.S. Provisional Patent Application No. 61/789,965 filed Mar. 15, 2013, and is a Continuation-in-Part under 35 USC § 365(c) of PCT Patent Application No. PCT/US13/23336 filed Jan. 27, 2013, which claims the benefit of priority under 35 USC § 119(e) to U.S. Provisional Patent Application No. 61/591,814 filed Jan. 27, 2012, all of which are incorporated herein by reference in their entireties.

BACKGROUND OF THE INVENTION

Field of the Invention

The present invention relates to an integrated hydrotreating and steam pyrolysis process for direct processing of a crude oil to produce petrochemicals such as olefins and aromatics.

Description of Related Art

The lower olefins (i.e., ethylene, propylene, butylene and butadiene) and aromatics (i.e., benzene, toluene and xylene) are basic intermediates which are widely used in the petrochemical and chemical industries. Thermal cracking, or steam pyrolysis, is a major type of process for forming these materials, typically in the presence of steam, and in the absence of oxygen. Feedstocks for steam pyrolysis can include petroleum gases and distillates such as naphtha, kerosene and gas oil. The availability of these feedstocks is usually limited and requires costly and energy-intensive process steps in a crude oil refinery.

Studies have been conducted using heavy hydrocarbons as a feedstock for steam pyrolysis reactors. A major drawback in conventional heavy hydrocarbon pyrolysis operations is coke formation. For example, a steam cracking process for heavy liquid hydrocarbons is disclosed in U.S. Pat. No. 4,217,204 in which a mist of molten salt is introduced into a steam cracking reaction zone in an effort to minimize coke formation. In one example using Arabian light crude oil having a Conradson carbon residue of 3.1% by weight, the cracking apparatus was able to continue operating for 624 hours in the presence of molten salt. In a comparative example without the addition of molten salt, the steam cracking reactor became clogged and inoperable after just 5 hours because of the formation of coke in the reactor.

In addition, the yields and distributions of olefins and aromatics using heavy hydrocarbons as a feedstock for a steam pyrolysis reactor are different than those using light hydrocarbon feedstocks. Heavy hydrocarbons have a higher content of aromatics than light hydrocarbons, as indicated by a higher Bureau of Mines Correlation Index (BMCI). BMCI is a measurement of aromaticity of a feedstock and is calculated as follows:

$$BMCI=87552/VAPB+473.5*(sp.gr.)-456.8 \quad (1)$$

where:

VAPB=Volume Average Boiling Point in degrees Rankine and sp. gr.=specific gravity of the feedstock.

As the BMCI decreases, ethylene yields are expected to increase. Therefore, highly paraffinic or low aromatic feeds are usually preferred for steam pyrolysis to obtain higher yields of desired olefins and to avoid higher undesirable products and coke formation in the reactor coil section.

The absolute coke formation rates in a steam cracker have been reported by Cai et al., "Coke Formation in Steam Crackers for Ethylene Production," *Chem. Eng. & Proc.*, vol. 41, (2002), 199-214. In general, the absolute coke formation rates are in the ascending order of olefins>aromatics>paraffins, wherein olefins represent heavy olefins.

To be able to respond to the growing demand of these petrochemicals, other type of feeds which can be made available in larger quantities, such as raw crude oil, are attractive to producers. Using crude oil feeds will minimize or eliminate the likelihood of the refinery being a bottleneck in the production of these petrochemicals.

While the steam pyrolysis process is well developed and suitable for its intended purposes, the choice of feedstocks has been very limited.

SUMMARY OF THE INVENTION

The system and process herein provides a steam pyrolysis zone integrated with a hydroprocessing zone including hydrogen redistribution to permit direct processing of crude oil feedstocks to produce petrochemicals including olefins and aromatics.

The integrated hydrotreating and steam pyrolysis process for the direct processing of a crude oil to produce olefinic and aromatic petrochemicals process comprises separating the crude oil into light components and heavy components; charging the heavy components and hydrogen to a hydroprocessing zone operating under conditions effective to produce a hydroprocessed effluent having a reduced content of contaminants, an increased paraffinicity, reduced Bureau of Mines Correlation Index, and an increased American Petroleum Institute gravity; charging the hydroprocessed effluent and steam to a convection section of a steam pyrolysis zone; heating the mixture from the convection section of a steam pyrolysis zone and passing it to a vapor-liquid separation section; removing from the steam pyrolysis zone a residual portion from the vapor-liquid separation section; charging light components from the initial separation step, a light portion from the vapor-liquid separation section, and steam to a pyrolysis section of the steam pyrolysis zone; recovering a mixed product stream from the steam pyrolysis zone; separating the mixed product stream; purifying hydrogen recovered from the mixed product stream and recycling it to the hydroprocessing zone; and recovering olefins and aromatics from the separated mixed product stream.

As used herein, the term "crude oil" is to be understood to include whole crude oil from conventional sources, including crude oil that has undergone some pre-treatment. The term crude oil will also be understood to include that which has been subjected to water-oil separation; and/or gas-oil separation; and/or desalting; and/or stabilization.

Other aspects, embodiments, and advantages of the process of the present invention are discussed in detail below. Moreover, it is to be understood that both the foregoing information and the following detailed description are merely illustrative examples of various aspects and embodiments, and are intended to provide an overview or framework for understanding the nature and character of the claimed features and embodiments. The accompanying drawings are illustrative and are provided to further the understanding of the various aspects and embodiments of the process of the invention.

BRIEF DESCRIPTION OF THE DRAWINGS

The invention will be described in further detail below and with reference to the attached drawings where.

DETAILED DESCRIPTION OF THE INVENTION

Figure 1:
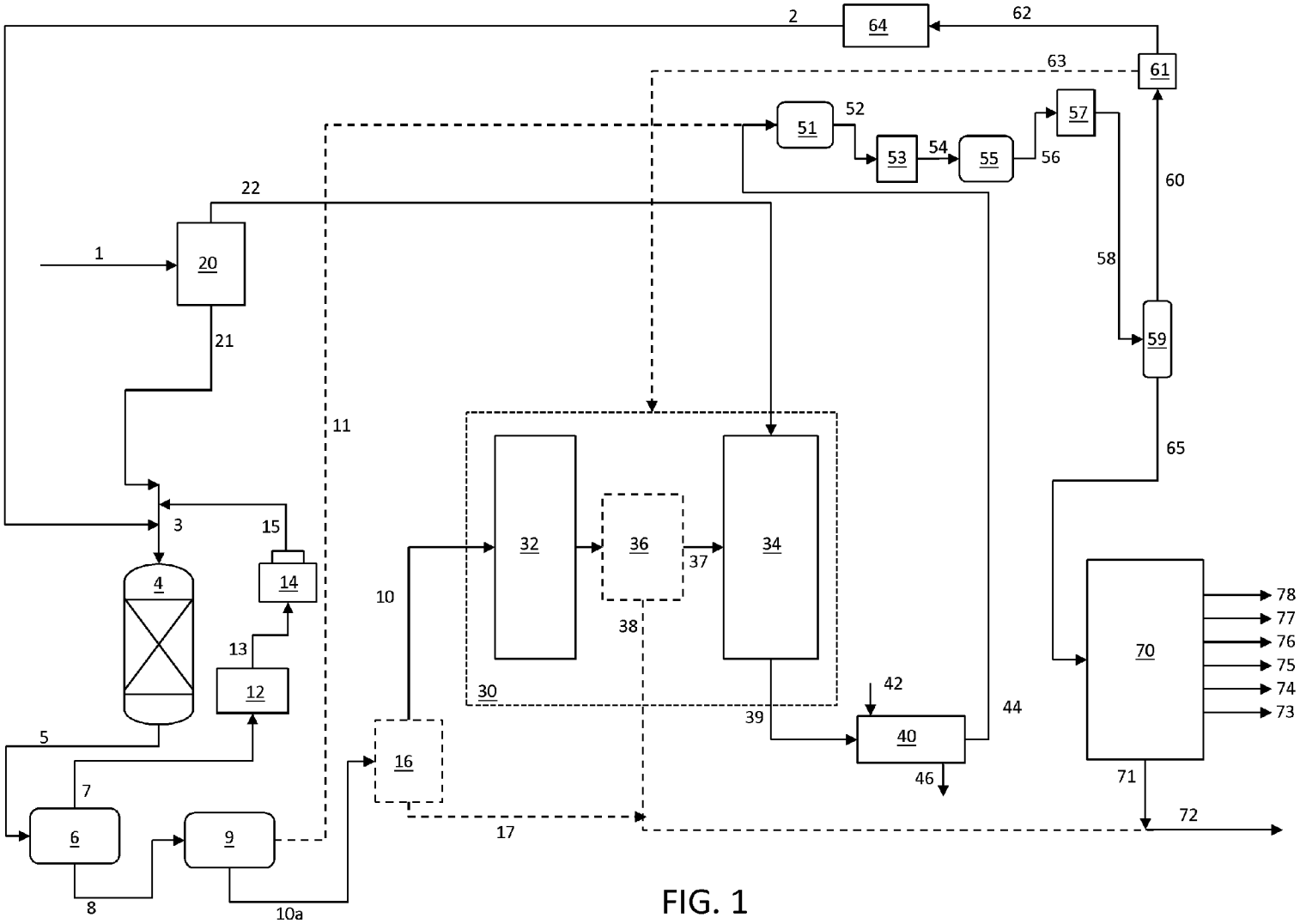
FIG. 1 is a process flow diagram of an embodiment of an integrated process described herein.

A process flow diagram including an integrated hydroprocessing and steam pyrolysis process and system including hydrogen redistribution is shown in FIG. 1. The integrated system generally includes an initial feed separation zone, a selective hydroprocessing zone, a steam pyrolysis zone and a product separation zone.

Generally, a crude oil feed is flashed, whereby the lighter fraction (having a boiling point in a range containing minimal hydrocarbons requiring further cracking and containing readily released hydrogen, e.g., up to about 185° C.) is directly passed to the steam pyrolysis zone and only the necessary fractions, i.e. having less than a predetermined hydrogen content, is hydroprocessed. This is advantageous as it provides increased partial pressure of hydrogen in the hydroprocessing reactor, improving the efficiency of hydrogen transfer via saturation. This will decrease hydrogen solution losses and $H_2$ consumption. Readily released hydrogen contained in the crude oil feed is redistributed to maximize the yield of products such as ethylene Redistribution of hydrogen allows for an overall reduction in heavy product and increased production of light olefins.

First separation zone 20 includes an inlet for receiving a feedstock stream 1, an outlet for discharging a light fraction 22 and an outlet for discharging a heavy fraction 21. Separation zone 20 can be a single stage separation device such a flash separator with a cut point in the range of from about 150° C. to about 260° C. In certain embodiments light fraction 22 can be a naphtha fraction. Table 1 shows the hydrogen content of hydrocarbon fractions based on various cut points.

In additional embodiments separation zone 20 includes, or consists essentially of (i.e., operates in the absence of a flash zone), a cyclonic phase separation device, or other separation device based on physical or mechanical separation of vapors and liquids. One example of a vapor-liquid separation device is illustrated by, and with reference to, FIGS. 2A-2C and 3A-3C. A similar arrangement of a vapor-liquid separation device is also described in U.S. Patent Publication Number 2011/0247500 which is incorporated by reference in its entirety herein. In embodiments in which the separation zone includes or consist essentially of a separation device based on physical or mechanical separation of vapors and liquids, the cut point can be adjusted based on vaporization temperature and the fluid velocity of the material entering the device.

TABLE 1

| Boiling point of light hydrocarbon fraction (° C.) | Hydrogen content (%) |
|---|---|
| 150 | 15.22 |
| 180 | 14.88 |
| 200 | 14.73 |
| 260 | 14.34 |

The hydroprocessing zone includes a hydroprocessing reaction zone 4 includes an inlet for receiving a mixture of light hydrocarbon fraction 21 and hydrogen 2 recycled from the steam pyrolysis product stream, and make-up hydrogen as necessary. Hydroprocessing reaction zone 4 further includes an outlet for discharging a hydroprocessed effluent 5.

Reactor effluents 5 from the hydroprocessing reactor(s) are cooled in a heat exchanger (not shown) and sent to a high pressure separator 6. The separator tops 7 are cleaned in an amine unit 12 and a resulting hydrogen rich gas stream 13 is passed to a recycling compressor 14 to be used as a recycle gas 15 in the hydroprocessing reactor. A bottoms stream 8 from the high pressure separator 6, which is in a substantially liquid phase, is cooled and introduced to a low pressure cold separator 9 in which it is separated into a gas stream 11 and a liquid stream 10. Gases from low pressure cold separator include hydrogen, $H_2S$, $NH_3$ and any light hydrocarbons such as $C_1$-$C_4$ hydrocarbons. Typically these gases are sent for further processing such as flare processing or fuel gas processing. According to certain embodiments herein, hydrogen is recovered by combining gas stream 11, which includes hydrogen, $H_2S$, $NH_3$ and any light hydrocarbons such as $C_1$-$C_4$ hydrocarbons, with steam cracker products 44. All or a portion of liquid stream 10 serves as the feed to the steam pyrolysis zone 30.

Steam pyrolysis zone 30 generally comprises a convection section 32 and a pyrolysis section 34 that can operate based on steam pyrolysis unit operations known in the art, i.e., charging the thermal cracking feed to the convection section in the presence of steam. In addition, in certain optional embodiments as described herein (as indicated with dashed lines in FIG. 1), a vapor-liquid separation section 36 is included between sections 32 and 34. Vapor-liquid separation section 36, through which the heated steam cracking feed from convection section 32 passes and is fractioned, can be a flash separation device, a separation device based on physical or mechanical separation of vapors and liquids or a combination including at least one of these types of devices. In additional embodiments, a vapor-liquid separation zone 16 is included upstream of sections 32, either in combination with a vapor-liquid separation zone 36 or in the absence of a vapor-liquid separation zone 36. Stream 10*a* is fractioned in separation zone 16, which can be a flash separation device, a separation device based on physical or mechanical separation of vapors and liquids or a combination including at least one of these types of devices.

Useful vapor-liquid separation devices are illustrated by, and with reference to FIGS. 2A-2C and 3A-3C. Similar arrangements of a vapor-liquid separation devices are described in U.S. Patent Publication Number 2011/0247500 which is herein incorporated by reference in its entirety. In this device vapor and liquid flow through in a cyclonic geometry whereby the device operates isothermally and at very low residence time. In general vapor is swirled in a circular pattern to create forces where heavier droplets and liquid to be captured and channeled through to a liquid outlet liquid residue, which is added to a pyrolysis fuel oil blend, and vapor is channeled through a vapor outlet. In embodiments in which a vapor-liquid separation device 36 is provided, residue 38 is discharged and the vapor is the charge 37 to the pyrolysis section 34. In embodiments in which a vapor-liquid separation device 16 is provided, residue 17 is discharged and the vapor is the charge 10 to the convection section 32. The vaporization temperature and fluid velocity are varied to adjust the approximate temperature cutoff point, for instance in certain embodiments compatible with the residue fuel oil blend, e.g., at about 540° C.

Rejected residuals derived from streams 17 and/or 38 have been subjected to the selective hydroprocessing zone and contain a reduced amount of heteroatom compounds including sulfur-containing, nitrogen-containing and metal compounds as compared to the initial feed. This facilitates further processing of these blends, or renders them useful as low sulfur, low nitrogen heavy fuel blends.

A quenching zone 40 includes an inlet in fluid communication with the outlet of steam pyrolysis zone 30 for receiving mixed product stream 39, an inlet for admitting a quenching solution 42, an outlet for discharging the quenched mixed product stream 44 and an outlet for discharging quenching solution 46.

In general, an intermediate quenched mixed product stream 44 is converted into intermediate product stream 65 and hydrogen 62, which is purified in the present process and used as recycle hydrogen stream 2 in the hydroprocessing reaction zone 4. Intermediate product stream 65 is generally fractioned into end-products and residue in separation zone 70, which can be one or multiple separation units such as plural fractionation towers including de-ethanizer, de-propanizer and de-butanizer towers, for example as is known to one of ordinary skill in the art. For example, suitable apparatus are described in "Ethylene," Ullmann's Encyclopedia of Industrial Chemistry, Volume 12, Pages 531-581, in particular FIG. 24, FIG. 25 and FIG. 26, which is incorporated herein by reference In general product separation zone 70 includes an inlet in fluid communication with with the product stream 65 and plural product outlets 73-78, including an outlet 78 for discharging methane, an outlet 77 for discharging ethylene, an outlet 76 for discharging propylene, an outlet 75 for discharging butadiene, an outlet 74 for discharging mixed butylenes, and an outlet 73 for discharging pyrolysis gasoline. Additionally an outlet is provided for discharging pyrolysis fuel oil 71. Optionally, the fuel oil portion 38 from vapor-liquid separation section 36 is combined with pyrolysis fuel oil 71 and can be withdrawn as a pyrolysis fuel oil blend 72, e.g., a low sulfur fuel oil blend to be further processed in an off-site refinery. Note that while six product outlets are shown, fewer or more can be provided depending, for instance, on the arrangement of separation units employed and the yield and distribution requirements.

In an embodiment of a process employing the arrangement shown in FIG. 1, a crude oil feedstock 1 is separated into light fraction 22 and heavy fraction 21 in first separation zone 20. The light fraction 22 is conveyed to the pyrolysis section 34, i.e., bypassing the hydroprocessing zone, to be combined with the portion of stream 10 and to produce a mixed product stream as described herein.

The heavy fraction 21 is mixed with an effective amount of hydrogen 2 and 15 to form a combined stream 3. The admixture 3 is charged to the inlet of selective hydroprocessing reaction zone 4 at a temperature in the range of from 300° C. to 450° C. In certain embodiments, hydroprocessing reaction zone 4 includes one or more unit operations as described in commonly owned United States Patent Publication Number 2011/0083996 and in PCT Patent Application Publication Numbers WO2010/009077, WO2010/009082, WO2010/009089 and WO2009/073436, all of which are incorporated by reference herein in their entireties. For instance, a hydroprocessing zone can include one or more beds containing an effective amount of hydrodemetallization catalyst, and one or more beds containing an effective amount of hydroprocessing catalyst having hydrodearomatization, hydrodenitrogenation, hydrodesulfurization and/or hydrocracking functions. In additional embodiments hydroprocessing reaction zone 4 includes more than two catalyst beds. In further embodiments hydroprocessing reaction zone 4 includes plural reaction vessels each containing one or more catalyst beds, e.g., of different function.

The hydroprocessing reaction zone 4 operates under parameters effective to hydrodemetallize, hydrodearomatize, hydrodenitrogenate, hydrodesulfurize and/or hydrocrack the crude oil feedstock. In certain embodiments, hydroprocessing is carried out using the following conditions: operating temperature in the range of from 300° C. to 450° C.; operating pressure in the range of from 30 bars to 180 bars; and a liquid hour space velocity in the range of from 0.1 $h^{-1}$ to 10 $h^{-1}$.

Reactor effluents 5 from the hydroprocessing zone 4 are cooled in an exchanger (not shown) and sent to a high pressure cold or hot separator 6. Separator tops 7 are cleaned in an amine unit 12 and the resulting hydrogen rich gas stream 13 is passed to a recycling compressor 14 to be used as a recycle gas 15 in the hydroprocessing reaction zone 4. Separator bottoms 8 from the high pressure separator 6, which are in a substantially liquid phase, are cooled and then introduced to a low pressure cold separator 9. Remaining gases, stream 11, including hydrogen, $H_2S$, $NH_3$ and any light hydrocarbons, which can include $C_1$-$C_4$ hydrocarbons, can be conventionally purged from the low pressure cold separator and sent for further processing, such as flare processing or fuel gas processing. In certain embodiments of the present process, hydrogen is recovered by combining stream 11 (as indicated by dashed lines) with the cracking gas, stream 44, from the steam cracker products. The bottoms 10 from the low pressure separator 9 are passed to steam pyrolysis zone 30.

The hydroprocessed effluent **10*a*** contains a reduced content of contaminants (i.e., metals, sulfur and nitrogen), an increased paraffinicity, reduced BMCI, and an increased American Petroleum Institute (API) gravity.

The hydroprocessed effluent **10*a* is passed to the convection section 32 as feed 10 in the presence of an effective amount of steam, e.g., admitted via a steam inlet (not shown). The steam cracking feed can have, for instance, an initial boiling point corresponding to that of the stream 10*a*** and a final boiling point in the range of about 370° C. to about 600° C.

The steam pyrolysis zone 30 operates under parameters effective to crack effluent 10 or a light portion 10 thereof derived from the optional separation zone 16, into desired products including ethylene, propylene, butadiene, mixed butenes and pyrolysis gasoline. In certain embodiments, steam cracking is carried out using the following conditions: a temperature in the range of from 400° C. to 900° C. in the convection section and in the pyrolysis section; a steam-to-hydrocarbon ratio in the convection section in the range of from 0.3:1 to 2:1 (wt.:wt.); and a residence time in the convection section and in the pyrolysis section in the range of from 0.05 seconds to 2 seconds.

In additional embodiments as described herein a separation zone 16 is incorporated upstream of the convection section 32 whereby the pyrolysis feed 10 is vapor phase separated from hydroprocessed effluent 10*a*.

In the convection section 32 the mixture is heated to a predetermined temperature, e.g., using one or more waste heat streams or other suitable heating arrangement. The heated mixture of the light fraction and steam is passed to the vapor-liquid separation section 36 to reject a portion 38 as a fuel oil component suitable for blending with pyrolysis fuel oil 71. The remaining hydrocarbon portion, together with the light fraction 22 from first separation zone 20, e.g., a naphtha fraction, is conveyed to the pyrolysis section 34 to produce a mixed product stream 39.

Figure 2B:
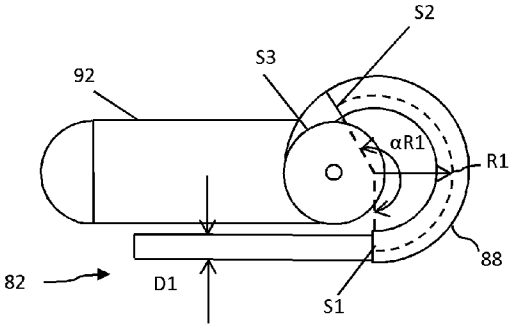
FIGS. 2A-2C are schematic illustrations in perspective, top and side views of a vapor-liquid separation device used in certain embodiments of the integrated process described herein.
Figure 2C:
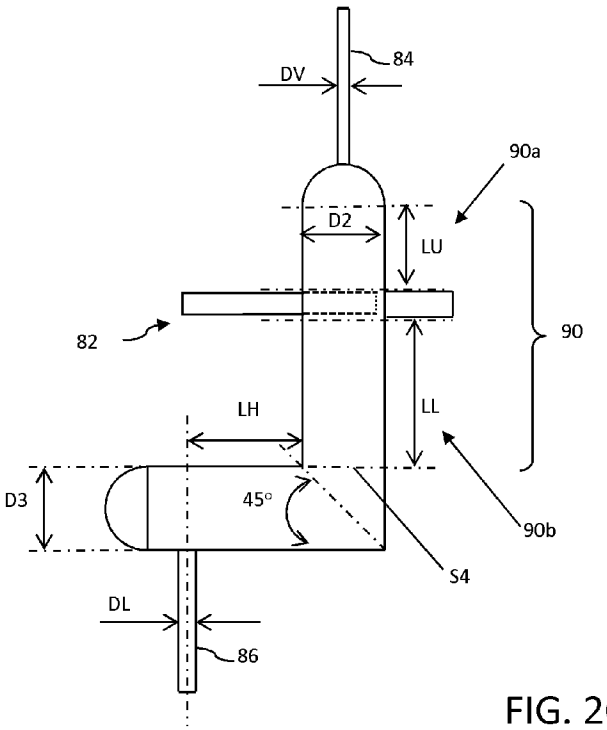
Figure 2A:
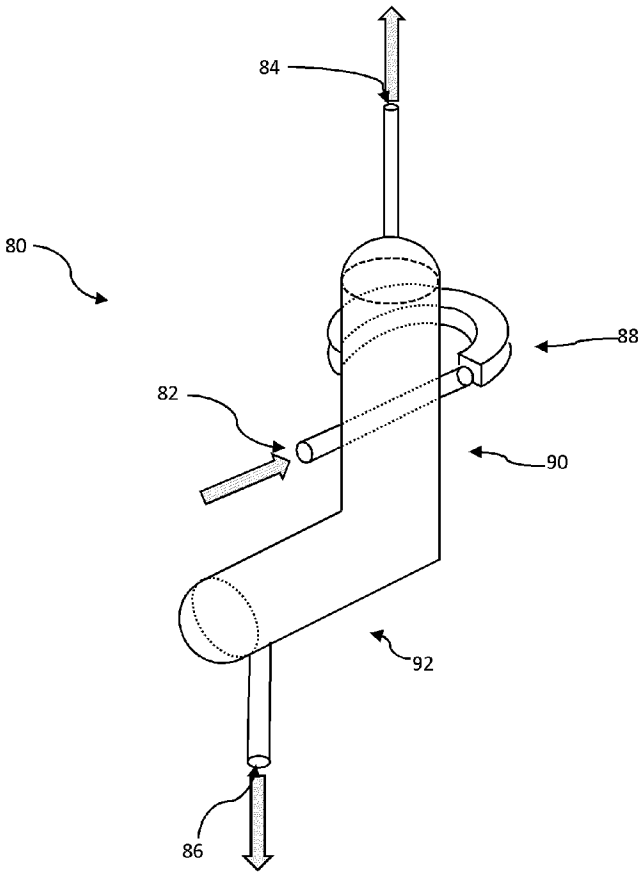

In certain embodiments, the vapor-liquid separation section 36 includes one or a plurality of vapor liquid separation devices 80 as shown in FIGS. 2A-2C. The vapor liquid separation device 80 is economical to operate and maintenance free since it does not require power or chemical supplies. In general, device 80 comprises three ports including an inlet port for receiving a vapor-liquid mixture, a vapor outlet port and a liquid outlet port for discharging and the collection of the separated vapor and liquid, respectively. Device 80 operates based on a combination of phenomena including conversion of the linear velocity of the incoming mixture into a rotational velocity by the global flow pre-rotational section, a controlled centrifugal effect to pre-separate the vapor from liquid (residue), and a cyclonic effect to promote separation of vapor from the liquid (residue). To attain these effects, device 80 includes a pre-rotational section 88, a controlled cyclonic vertical section 90 and a liquid collector/settling section 92.

As shown in FIG. 2B, the pre-rotational section 88 includes a controlled pre-rotational element between cross-section (S1) and cross-section (S2), and a connection element to the controlled cyclonic vertical section 90 and located between cross-section (S2) and cross-section (S3). The vapor liquid mixture coming from inlet 82 having a diameter (D1) enters the apparatus tangentially at the cross-section (S1). The area of the entry section (S1) for the incoming flow is at least 10% of the area of the inlet 82 according to the following equation:

$$\frac{n*([D1])^2}{4} \tag{2}$$

The pre-rotational element 88 defines a curvilinear flow path, and is characterized by constant, decreasing or increasing cross-section from the inlet cross-section S1 to the outlet cross-section S2. The ratio between outlet cross-section from controlled pre-rotational element (S2) and the inlet cross-section (S1) is in certain embodiments in the range of $0.7 \leq S2/S1 \leq 1.4$.

The rotational velocity of the mixture is dependent on the radius of curvature (R1) of the center-line of the pre-rotational element 38 where the center-line is defined as a curvilinear line joining all the center points of successive cross-sectional surfaces of the pre-rotational element 88. In certain embodiments the radius of curvature (R1) is in the range of $2 \leq R1/D1 \leq 6$ with opening angle in the range of $150° \leq \alpha R1 \leq 250°$.

The cross-sectional shape at the inlet section S1, although depicted as generally square, can be a rectangle, a rounded rectangle, a circle, an oval, or other rectilinear, curvilinear or a combination of the aforementioned shapes. In certain embodiments, the shape of the cross-section along the curvilinear path of the pre-rotational element 38 through which the fluid passes progressively changes, for instance, from a generally square shape to a rectangular shape. The progressively changing cross-section of element 88 into a rectangular shape advantageously maximizes the opening area, thus allowing the gas to separate from the liquid mixture at an early stage and to attain a uniform velocity profile and minimize shear stresses in the fluid flow.

The fluid flow from the controlled pre-rotational element 88 from cross-section (S2) passes section (S3) through the connection element to the controlled cyclonic vertical section 90. The connection element includes an opening region that is open and connected to, or integral with, an inlet in the controlled cyclonic vertical section 90. The fluid flow enters the controlled cyclonic vertical section 90 at a high rotational velocity to generate the cyclonic effect. The ratio between connection element outlet cross-section (S3) and inlet cross-section (S2) in certain embodiments is in the range of $2 \leq S3/S1 \leq 5$.

The mixture at a high rotational velocity enters the cyclonic vertical section 90. Kinetic energy is decreased and the vapor separates from the liquid under the cyclonic effect. Cyclones form in the upper level 90*a* and the lower level 90*b* of the cyclonic vertical section 90. In the upper level 90*a*, the mixture is characterized by a high concentration of vapor, while in the lower level 90*b* the mixture is characterized by a high concentration of liquid.

In certain embodiments, the internal diameter D2 of the cyclonic vertical section 90 is within the range of $2 \leq D2/D1 \leq 5$ and can be constant along its height, the length (LU) of the upper portion 90*a* is in the range of $1.2 \leq LU/D2 \leq 3$, and the length (LL) of the lower portion 90*b* is in the range of $2 \leq LL/D2 \leq 5$.

The end of the cyclonic vertical section 90 proximate vapor outlet 84 is connected to a partially open release riser and connected to the pyrolysis section of the steam pyrolysis unit. The diameter (DV) of the partially open release is in certain embodiments in the range of $0.05 \leq DV/D2 \leq 0.4$.

Accordingly, in certain embodiments, and depending on the properties of the incoming mixture, a large volume fraction of the vapor therein exits device 80 from the outlet 84 through the partially open release pipe with a diameter DV. The liquid phase (e.g., residue) with a low or non-existent vapor concentration exits through a bottom portion of the cyclonic vertical section 90 having a cross-sectional area S4, and is collected in the liquid collector and settling pipe 92.

The connection area between the cyclonic vertical section 90 and the liquid collector and settling pipe 92 has an angle in certain embodiments of 90°. In certain embodiments the internal diameter of the liquid collector and settling pipe 92 is in the range of $2 \leq D3/D1 \leq 4$ and is constant across the pipe length, and the length (LH) of the liquid collector and settling pipe 92 is in the range of $1.2 \leq LH/D3 \leq 5$. The liquid with low vapor volume fraction is removed from the apparatus through pipe 86 having a diameter of DL, which in certain embodiments is in the range of $0.05 \leq DL/D3 \leq 0.4$ and located at the bottom or proximate the bottom of the settling pipe.

In certain embodiments, a vapor-liquid separation device is provided similar in operation and structure to device 80 without the liquid collector and settling pipe return portion.

Figures 3A, 3B, 3C:
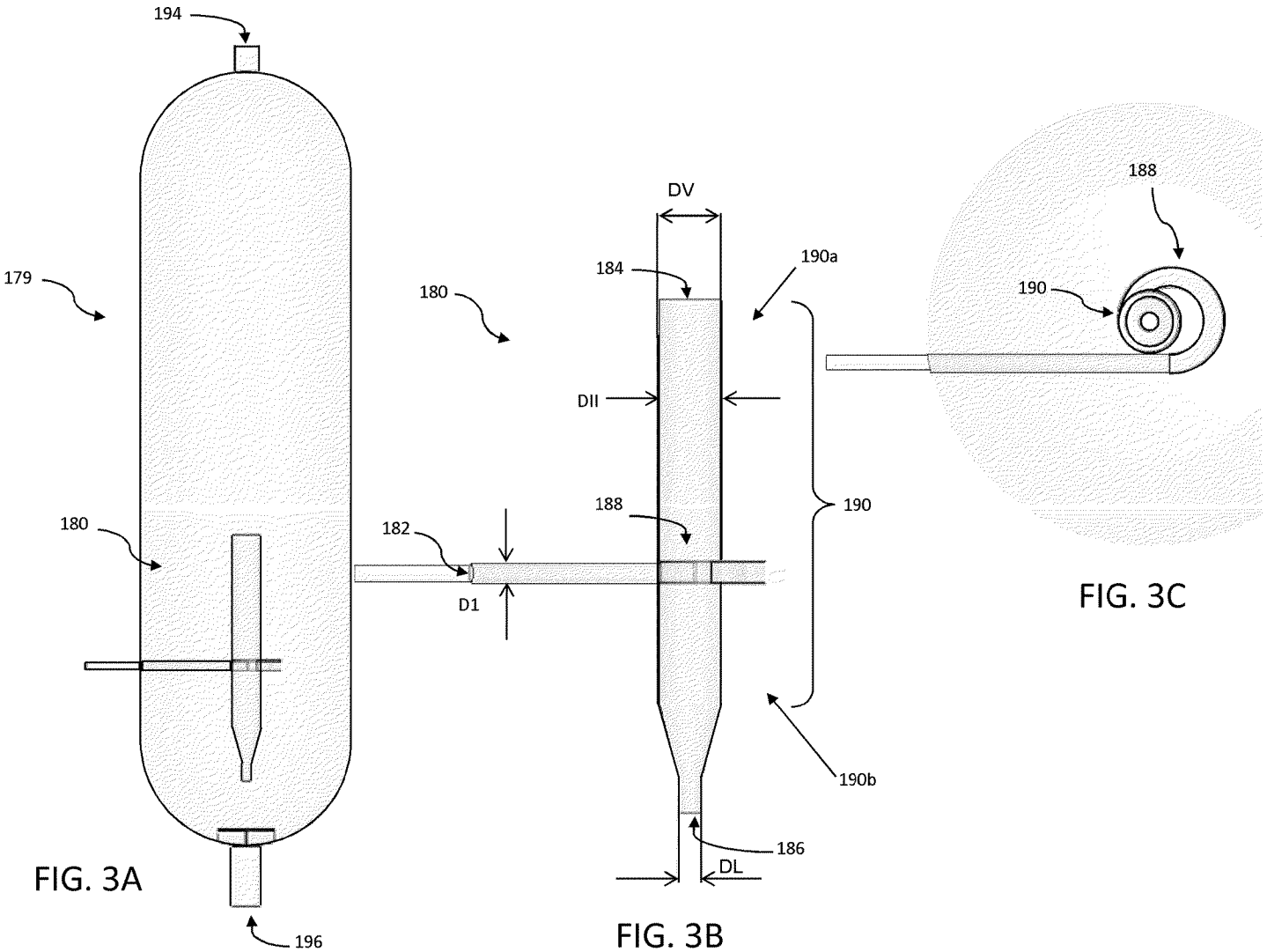
FIGS. 3A-3C are schematic illustrations in section, enlarged section and top section views of a vapor-liquid separation device in a flash vessel used in certain embodiments of the integrated process described herein.

For instance, a vapor-liquid separation device 180 is used as inlet portion of a flash vessel 179, as shown in FIGS. 3A-3C. In these embodiments the bottom of the vessel 179 serves as a collection and settling zone for the recovered liquid portion from device 180.

In general a vapor phase is discharged through the top 194 of the flash vessel 179 and the liquid phase is recovered from the bottom 196 of the flash vessel 179. The vapor-liquid separation device 180 is economical to operate and maintenance free since it does not require power or chemical supplies. Device 180 comprises three ports including an inlet port 182 for receiving a vapor-liquid mixture, a vapor outlet port 184 for discharging separated vapor and a liquid outlet port 186 for discharging separated liquid. Device 180 operates based on a combination of phenomena including conversion of the linear velocity of the incoming mixture into a rotational velocity by the global flow pre-rotational section, a controlled centrifugal effect to pre-separate the vapor from liquid, and a cyclonic effect to promote separation of vapor from the liquid. To attain these effects, device 180 includes a pre-rotational section 188 and a controlled cyclonic vertical section 190 having an upper portion 190*a* and a lower portion 190*b*. The vapor portion having low liquid volume fraction is discharged through the vapor outlet port 184 having a diameter (DV). Upper portion 190*a* which is partially or totally open and has an internal diameter (DII) in certain embodiments in the range of $0.5<DV/DII<1.3$. The liquid portion with low vapor volume fraction is discharged from liquid port 186 having an internal diameter (DL) in certain embodiments in the range of $0.1<DL/DII<1.1$. The liquid portion is collected and discharged from the bottom of flash vessel 179.

In order to enhance and to control phase separation, heating steam can be used in the vapor-liquid separation device 80 or 180, particularly when used as a standalone apparatus or is integrated within the inlet of a flash vessel.

While the various members are described separately and with separate portions, it will be understood by one of ordinary skill in the art that apparatus 80 or apparatus 180 can be formed as a monolithic structure, e.g., it can be cast or molded, or it can be assembled from separate parts, e.g., by welding or otherwise attaching separate components together which may or may not correspond precisely to the members and portions described herein.

It will be appreciated that although various dimensions are set forth as diameters, these values can also be equivalent effective diameters in embodiments in which the components parts are not cylindrical.

Mixed product stream 39 is passed to the inlet of quenching zone 40 with a quenching solution 42 (e.g., water and/or pyrolysis fuel oil) introduced via a separate inlet to produce an intermediate quenched mixed product stream 44 having a reduced temperature, e.g., of about 300° C., and spent quenching solution 46 is discharged. The gas mixture effluent 39 from the cracker is typically a mixture of hydrogen, methane, hydrocarbons, carbon dioxide and hydrogen sulfide. After cooling with water or oil quench, mixture 44 is compressed in a multi-stage compressor zone 51, typically in 4-6 stages to produce a compressed gas mixture 52. The compressed gas mixture 52 is treated in a caustic treatment unit 53 to produce a gas mixture 54 depleted of hydrogen sulfide and carbon dioxide. The gas mixture 54 is further compressed in a compressor zone 55, and the resulting cracked gas 56 typically undergoes a cryogenic treatment in unit 57 to be dehydrated, and is further dried by use of molecular sieves.

The cold cracked gas stream 58 from unit 57 is passed to a de-methanizer tower 59, from which an overhead stream 60 is produced containing hydrogen and methane from the cracked gas stream. The bottoms stream 65 from de-methanizer tower 59 is then sent for further processing in product separation zone 70, comprising fractionation towers including de-ethanizer, de-propanizer and de-butanizer towers. Process configurations with a different sequence of de-methanizer, de-ethanizer, de-propanizer and de-butanizer can also be employed.

According to the processes herein, after separation from methane at the de-methanizer tower 59 and hydrogen recovery in unit 61, hydrogen 62 having a purity of typically 80-95 vol % is obtained. Recovery methods in unit 61 include cryogenic recovery (e.g., at a temperature of about −157° C.). Hydrogen stream 62 is then passed to a hydrogen purification unit 64, such as a pressure swing adsorption (PSA) unit to obtain a hydrogen stream 2 having a purity of 99.9%+, or a membrane separation units to obtain a hydrogen stream 2 with a purity of about 95%. The purified hydrogen stream 2 is then recycled back to serve as a major portion of the requisite hydrogen for the hydroprocessing zone. In addition, a minor proportion can be utilized for the hydrogenation reactions of acetylene, methylacetylene and propadienes (not shown). In addition, according to the processes herein, methane stream 63 can optionally be recycled to the steam cracker to be used as fuel for burners and/or heaters.

The bottoms stream 65 from de-methanizer tower 59 is conveyed to the inlet of product separation zone 70 to be separated into methane, ethylene, propylene, butadiene, mixed butylenes and pyrolysis gasoline discharged via outlets 78, 77, 76, 75, 74 and 73, respectively. Pyrolysis gasoline generally includes C5-C9 hydrocarbons, and benzene, toluene and xylenes can be extracted from this cut. Optionally, the rejected portion 38 from vapor-liquid separation section 36 is combined with pyrolysis fuel oil 71 (e.g., materials boiling at a temperature higher than the boiling point of the lowest boiling C10 compound, known as a "C10+" stream) and the mixed stream can be withdrawn as a pyrolysis fuel oil blend 72, e.g., a low sulfur fuel oil blend to be further processed in an off-site refinery.

Advantages of the system described herein with respect to FIG. 1 include increased partial pressure of hydrogen in the reactor and improved efficiency of hydrogen transfer via saturation. In general, $$PT=PA+PB+PC. \quad (3)$$

In the present case, $$PT=P\text{Naphtha}+PH2+PX+PY. \quad (4)$$

If we remove the PNaphta then PT remains the same and so PH2 (and PX and PY) all increase.

$$\text{Rate(saturation)}=k\text{Sat}[\text{REACTANT}]\times[\text{pH2}]. \quad (5)$$

The system described herein also decreases solution losses and decreases $H_2$ consumption. This makes possible the operation of such a system as closed or near-closed system.

In certain embodiments, selective hydroprocessing or hydrotreating processes can increase the paraffin content (or decrease the BMCI) of a feedstock by saturation followed by mild hydrocracking of aromatics, especially polyaromatics. When hydrotreating a crude oil, contaminants such as metals, sulfur and nitrogen can be removed by passing the feedstock through a series of layered catalysts that perform the catalytic functions of demetallization, desulfurization and/or denitrogenation.

In one embodiment, the sequence of catalysts to perform hydrodemetallization (HDM) and hydrodesulfurization (HDS) is as follows:

A hydrodemetallization catalyst. The catalyst in the HDM section are generally based on a gamma alumina support, with a surface area of about 140-240 $m^2/g$. This catalyst is best described as having a very high pore volume, e.g., in excess of 1 $cm^3/g$. The pore size itself is typically predominantly macroporous. This is required to provide a large capacity for the uptake of metals on the catalysts surface and optionally dopants. Typically the active metals on the catalyst surface are sulfides of Nickel and Molybdenum in the ratio Ni/Ni+Mo<0.15. The concentration of Nickel is lower on the HDM catalyst than other catalysts as some Nickel and Vanadium is anticipated to be deposited from the feedstock itself during the removal, acting as catalyst. The dopant used can be one or more of phosphorus (see, e.g., United States Patent Publication Number US 2005/0211603 which is incorporated by reference herein), boron, silicon and halogens. The catalyst can be in the form of alumina extrudates or alumina beads. In certain embodiments alumina beads are used to facilitate un-loading of the catalyst HDM beds in the reactor as the metals uptake will range between from 30 to 100% at the top of the bed.

An intermediate catalyst can also be used to perform a transition between the HDM and HDS function. It has intermediate metals loadings and pore size distribution. The catalyst in the HDM/HDS reactor is essentially alumina based support in the form of extrudates, optionally at least one catalytic metal from group VI (e.g., molybdenum and/or tungsten), and/or at least one catalytic metals from group VIII (e.g., nickel and/or cobalt). The catalyst also contains optionally at least one dopant selected from boron, phosphorous, halogens and silicon. Physical properties include a surface area of about 140-200 $m^2/g$, a pore volume of at least 0.6 $cm^3/g$ and pores which are mesoporous and in the range of 12 to 50 nm.

The catalyst in the HDS section can include those having gamma alumina based support materials, with typical surface area towards the higher end of the HDM range, e.g. about ranging from 180-240 $m^2/g$. This required higher surface for HDS results in relatively smaller pore volume, e.g., lower than 1 $cm^3/g$. The catalyst contains at least one element from group VI, such as molybdenum and at least one element from group VIII, such as nickel. The catalyst also comprises at least one dopant selected from boron, phosphorous, silicon and halogens. In certain embodiments cobalt is used to provide relatively higher levels of desulfurization. The metals loading for the active phase is higher as the required activity is higher, such that the molar ratio of Ni/Ni+Mo is in the range of from 0.1 to 0.3 and the (Co+Ni)/Mo molar ratio is in the range of from 0.25 to 0.85.

A final catalyst (which could optionally replace the second and third catalyst) is designed to perform hydrogenation of the feedstock (rather than a primary function of hydrodesulfurization), for instance as described in Appl. Catal. A General, 204 (2000) 251. The catalyst will be also promoted by Ni and the support will be wide pore gamma alumina. Physical properties include a surface area towards the higher end of the HDM range, e.g., 180-240 $m^2/g$ gr. This required higher surface for HDS results in relatively smaller pore volume, e.g., lower than 1 $cm^3/g$.

The method and system herein provides improvements over known steam pyrolysis cracking processes, including the ability to use crude oil as a feedstock to produce petrochemicals such as olefins and aromatics. Further impurities such as metals, sulfur and nitrogen compounds are also significantly removed from the starting feed which avoids post treatments of the final products.

In addition, hydrogen produced from the steam cracking zone is recycled to the hydroprocessing zone to minimize the demand for fresh hydrogen. In certain embodiments the integrated systems described herein only require fresh hydrogen to initiate the operation. Once the reaction reaches the equilibrium, the hydrogen purification system can provide enough high purity hydrogen to maintain the operation of the entire system.

The method and system of the present invention have been described above and in the attached drawings; however, modifications will be apparent to those of ordinary skill in the art and the scope of protection for the invention is to be defined by the claims that follow.

The invention claimed is:

1. An integrated hydrotreating and steam pyrolysis system for the direct processing of a crude oil to produce olefinic and aromatic petrochemicals, the system comprising:

a separation zone having a heavy fraction outlet and a light fraction outlet;

a catalytic hydroprocessing zone in fluid communication with the heavy fraction outlet of the separation zone having inlet for receiving a mixture of the heavy fraction and hydrogen recycled from a steam pyrolysis product stream effluent, and make-up hydrogen as necessary, and an outlet for discharging a hydroprocessed effluent, the catalytic hydroprocessing zone including a reactor operating under conditions effective to produce a hydroprocessed effluent;

a thermal cracking zone including a thermal cracking convection section with an inlet in fluid communication with the hydroprocessing zone outlet, and an outlet, a vapor-liquid separator having an inlet in fluid communication with the thermal cracking convection section outlet, a vapor fraction outlet and a liquid fraction outlet, wherein the vapor-liquid separator includes:

a pre-rotational element having an entry portion and a transition portion, the entry portion having an inlet for receiving a flowing fluid mixture from the thermal cracking convection section outlet, and a curvilinear conduit;

a controlled cyclonic section having an inlet adjoined to the pre-rotational element through convergence of the curvilinear conduit and the cyclonic section, a riser section at an upper end of the cyclonic member through a vapor fraction outlet through which vapors pass to a thermal cracking pyrolysis section;

and a liquid collector/settling section through which liquid passes, and the thermal cracking pyrolysis section having an inlet in fluid communication with the vapor fraction outlet of the vapor-liquid separator, and a pyrolysis section outlet;

a quenching zone in fluid communication with the pyrolysis section outlet, the quenching zone having an outlet for discharging an intermediate quenched mixed product stream and an outlet for discharging quenching solution;

a product separation zone in fluid communication with the intermediate quenched mixed product stream outlet, and having a hydrogen outlet, one or more olefin product outlets and one or more pyrolysis fuel oil outlets; and a hydrogen purification zone in fluid communication with the product separation zone hydrogen outlet, the hydrogen purification zone having an outlet in fluid communication with the hydroprocessing zone.

2. The integrated system of claim 1, further comprising a first compressor zone having an inlet in fluid communication with the quenching zone outlet discharging an intermediate quenched mixed product stream and an outlet discharging a compressed gas mixture;

a caustic treatment unit having an inlet in fluid communication with the first compressor zone outlet discharging a compressed gas mixture, and an outlet discharging a gas mixture depleted of hydrogen sulfide and carbon dioxide; and a second compressor zone having an inlet in fluid communication with the caustic treatment unit outlet, and an outlet for discharging compressed cracked gas;

a dehydration zone having an inlet in fluid communication with the second compressor zone outlet, and an outlet for discharging a cold cracked gas stream;

a de-methanizer unit having an inlet in fluid communication with the dehydration zone outlet, an outlet for discharging an overhead stream containing hydrogen and methane and an outlet for discharging a bottoms stream, wherein the hydrogen purification zone is in fluid communication with the de-methanizer unit overhead outlet and the product separation zone including de-ethanizer, de-propanizer and de-butanizer towers, wherein the de-ethanizer tower is in fluid communication with the bottoms stream of the de-methanizer unit.

3. The integrated system of claim 2, further comprising burners and/or heaters associated with the thermal cracking zone in fluid communication with the de-methanizer unit.

4. The integrated system of claim 1, further comprising a high pressure separator in fluid communication with the hydroprocessing zone reactor and having a gas portion outlet in fluid communication with the hydroprocessing zone reactor and a liquid portion outlet, and a low pressure separator in fluid communication liquid portion outlet of the high pressure separator, and having a gas portion outlet and a liquid portion outlet in fluid communication with the thermal cracking convection section inlet.

5. The integrated system of claim 4, wherein the gas portion outlet of the low pressure separator is in fluid communication with the intermediate quenched mixed product stream.

6. The integrated system of claim 1, further comprising a hydroprocessed effluent vapor-liquid separator having an inlet in fluid communication with the hydroprocessing zone outlet, a vapor fraction outlet and a liquid fraction outlet, the vapor fraction outlet in fluid communication with the convection section.

7. The integrated system of claim 6 wherein the hydroprocessed effluent vapor-liquid separator is a physical or mechanical apparatus for separation of vapors and liquids.

8. The integrated system of claim 6 wherein the hydroprocessed effluent vapor-liquid separator includes a pre-rotational element having an entry portion and a transition portion, the entry portion having an inlet for receiving a flowing fluid mixture and a curvilinear conduit, a controlled cyclonic section having an inlet adjoined to the pre-rotational element through convergence of the curvilinear conduit and the cyclonic section, a riser section at an upper end of the cyclonic member in fluid communication with the vapor fraction outlet of the hydroprocessed effluent vapor-liquid separator through which vapors pass;

and a liquid collector/settling section in fluid communication with the liquid fraction outlet of the hydroprocessed effluent vapor-liquid separator through liquid passes.

9. An integrated hydrotreating and steam pyrolysis system for the direct processing of a crude oil to produce olefinic and aromatic petrochemicals, the system comprising:

a separation zone having a heavy fraction outlet and a light fraction outlet;

a catalytic hydroprocessing zone in fluid communication with the heavy fraction outlet of the separation zone having inlet for receiving a mixture of the heavy components and hydrogen recycled from a steam pyrolysis product stream effluent, and make-up hydrogen as necessary, and an outlet for discharging a hydroprocessed effluent, the catalytic hydroprocessing zone including a reactor operating under conditions effective to produce a hydroprocessed effluent;

a hydroprocessed effluent vapor-liquid separator having an inlet in fluid communication with the hydroprocessing zone outlet, a vapor fraction outlet and a liquid fraction outlet, wherein the hydroprocessed effluent vapor-liquid separator includes a pre-rotational element having an entry portion and a transition portion, the entry portion having an inlet for receiving a flowing fluid mixture and a curvilinear conduit, a controlled cyclonic section having an inlet adjoined to the pre-rotational element through convergence of the curvilinear conduit and the cyclonic section, a riser section at an upper end of the cyclonic member through a vapor fraction outlet through which vapors pass;

and a liquid collector/settling section through which liquid passes;

the thermal cracking zone including a thermal cracking convection section with an inlet in fluid communication with the vapor fraction outlet of the hydroprocessed effluent vapor-liquid separator, and an outlet, and a thermal cracking pyrolysis section having an inlet in fluid communication with the outlet of the convection section and the light fraction outlet, and a pyrolysis section outlet;

a quenching zone in fluid communication with the pyrolysis section outlet, the quenching zone having an outlet for discharging an intermediate quenched mixed product stream and an outlet for discharging quenching solution;

a product separation zone in fluid communication with the intermediate quenched mixed product stream outlet, and having a hydrogen outlet, one or more olefin product outlets and one or more pyrolysis fuel oil outlets; and a hydrogen purification zone in fluid communication with the product separation zone hydrogen outlet, the hydrogen purification zone having an outlet in fluid communication with the hydroprocessing zone.

10. The integrated system of claim 9, further comprising a first compressor zone having an inlet in fluid communication with the quenching zone outlet discharging an intermediate quenched mixed product stream and an outlet discharging a compressed gas mixture;

a caustic treatment unit having an inlet in fluid communication with the first compressor zone outlet discharging a compressed gas mixture, and an outlet discharging a gas mixture depleted of hydrogen sulfide and carbon dioxide; and a second compressor zone having an inlet in fluid communication with the caustic treatment unit outlet, and an outlet for discharging compressed cracked gas;

a dehydration zone having an inlet in fluid communication with the second compressor zone outlet, and an outlet for discharging a cold cracked gas stream;

a de-methanizer unit having an inlet in fluid communication with the dehydration zone outlet, an outlet for discharging an overhead stream containing hydrogen and methane and an outlet for discharging a bottoms stream, wherein the hydrogen purification zone is in fluid communication with the de-methanizer unit overhead outlet and the product separation zone including de-ethanizer, de-propanizer and de-butanizer towers, wherein the de-ethanizer tower is in fluid communication with the bottoms stream of the de-methanizer unit.

11. The integrated system of claim 10, further comprising burners and/or heaters associated with the thermal cracking zone in fluid communication with the de-methanizer unit.

12. The integrated system of claim 9, further comprising a thermal cracking vapor-liquid separator having an inlet in fluid communication with the thermal cracking convection section outlet, a vapor fraction outlet and a liquid fraction outlet, the vapor fraction outlet in fluid communication with the pyrolysis section.

13. The integrated system of claim 11, further comprising a thermal cracking vapor-liquid separator is a physical or mechanical apparatus for separation of vapors and liquids.

14. The integrated system of claim 12, further comprising a thermal cracking vapor-liquid separator includes a pre-rotational element having an entry portion and a transition portion, the entry portion having an inlet for receiving a flowing fluid mixture and a curvilinear conduit, a controlled cyclonic section having an inlet adjoined to the pre-rotational element through convergence of the curvilinear conduit and the cyclonic section, a riser section at an upper end of the cyclonic member in fluid communication with the vapor fraction outlet of the thermal cracking vapor liquid separator through which vapors pass;

and a liquid collector/settling section in fluid communication with the liquid fraction outlet of the thermal cracking vapor liquid separator through which liquid passes.

15. The integrated system of claim 9, further comprising a high pressure separator in fluid communication with the hydroprocessing zone reactor and having a gas portion outlet in fluid communication with the hydroprocessing zone reactor and a liquid portion outlet, and a low pressure separator in fluid communication liquid portion outlet of the high pressure separator, and having a gas portion outlet and a liquid portion outlet in fluid communication with the thermal cracking convection section inlet.

16. The integrated system of claim 15, wherein the gas portion outlet of the low pressure separator is in fluid communication with the intermediate quenched mixed product stream.

17. An integrated hydrotreating and steam pyrolysis system for the direct processing of a crude oil to produce olefinic and aromatic petrochemicals, the system comprising:

a separation zone having a heavy fraction outlet and a light fraction outlet;

a catalytic hydroprocessing zone in fluid communication with the heavy fraction outlet of the separation zone having inlet for receiving a mixture of the heavy fraction and hydrogen recycled from a steam pyrolysis product stream effluent, and make-up hydrogen as necessary, and an outlet for discharging a hydroprocessed effluent, the catalytic hydroprocessing zone including a reactor operating under conditions effective to produce a hydroprocessed effluent;

a high pressure separator in fluid communication with the hydroprocessing zone reactor and having a gas portion outlet in fluid communication with the hydroprocessing zone reactor and a liquid portion outlet;

a low pressure separator in fluid communication liquid portion outlet of the high pressure separator, and having a gas portion outlet and a liquid portion outlet;

the thermal cracking zone including a thermal cracking convection section with an inlet in fluid communication with the liquid portion outlet of the low pressure separator, and an outlet, and a thermal cracking pyrolysis section having an inlet in fluid communication with the outlet of the convection section and the light fraction outlet, and a pyrolysis section outlet;

a quenching zone in fluid communication with the pyrolysis section outlet, the quenching zone having an outlet for discharging an intermediate quenched mixed product stream and an outlet for discharging quenching solution;

a product separation zone in fluid communication with the intermediate quenched mixed product stream outlet, and having a hydrogen outlet, one or more olefin product outlets and one or more pyrolysis fuel oil outlets; and a hydrogen purification zone in fluid communication with the product separation zone hydrogen outlet, the hydrogen purification zone having an outlet in fluid communication with the hydroprocessing zone.

18. The integrated system of claim 17, wherein the gas portion outlet of the low pressure separator is in fluid communication with the intermediate quenched mixed product stream.

19. The integrated system of claim 17, further comprising a first compressor zone having an inlet in fluid communication with the quenching zone outlet discharging an intermediate quenched mixed product stream and an outlet discharging a compressed gas mixture;

a caustic treatment unit having an inlet in fluid communication with the first compressor zone outlet discharging a compressed gas mixture, and an outlet discharging a gas mixture depleted of hydrogen sulfide and carbon dioxide; and a second compressor zone having an inlet in fluid communication with the caustic treatment unit outlet, and an outlet for discharging compressed cracked gas;

a dehydration zone having an inlet in fluid communication with the second compressor zone outlet, and an outlet for discharging a cold cracked gas stream;

a de-methanizer unit having an inlet in fluid communication with the dehydration zone outlet, an outlet for discharging an overhead stream containing hydrogen and methane and an outlet for discharging a bottoms stream, wherein the hydrogen purification zone is in fluid communication with the de-methanizer unit overhead outlet and the product separation zone including de-ethanizer, de-propanizer and de-butanizer towers, wherein the de-ethanizer tower is in fluid communication with the bottoms stream of the de-methanizer unit.

20. The integrated system of claim 19, further comprising burners and/or heaters associated with the thermal cracking zone in fluid communication with the de-methanizer unit.

21. The integrated system of claim 17, further comprising a thermal cracking vapor-liquid separator having an inlet in fluid communication with the thermal cracking convection section outlet, a vapor fraction outlet and a liquid fraction outlet, the vapor fraction outlet in fluid communication with the pyrolysis section.

22. The integrated system of claim 21, wherein the thermal cracking vapor-liquid separator is a physical or mechanical apparatus for separation of vapors and liquids.

23. The integrated system of claim 17, further comprising a hydroprocessed effluent vapor-liquid separator having an inlet in fluid communication with the liquid portion outlet of the low pressure separator, a vapor fraction outlet and a liquid fraction outlet, the vapor fraction outlet in fluid communication with the convection section.

24. The integrated system of claim 23 wherein the hydroprocessed effluent vapor-liquid separator is a physical or mechanical apparatus for separation of vapors and liquids.

* * * * *